US007627987B2

(12) United States Patent
Thielmann et al.

(10) Patent No.: US 7,627,987 B2
(45) **Date of Patent: *Dec. 8, 2009**

(54) COMBINED SEALING SYSTEM AND SEAL ACTIVATION SYSTEM FOR DOOR

(75) Inventors: Jonathan D Thielmann, Boca Raton, FL (US); Robert E Pruss, Delray Beach, FL (US)

(73) Assignee: Speyer Door and Window, Inc., Boca Raton, FL (US)

( * ) Notice: Subject to any disclaimer, the term of this patent is extended or adjusted under 35 U.S.C. 154(b) by 616 days.

This patent is subject to a terminal disclaimer.

(21) Appl. No.: 11/425,386

(22) Filed: Jun. 20, 2006

(65) Prior Publication Data

US 2007/0151163 A1 Jul. 5, 2007

Related U.S. Application Data

(63) Continuation-in-part of application No. 11/322,953, filed on Dec. 30, 2005.

(51) Int. Cl.
*E06B 7/28* (2006.01)

(52) U.S. Cl. ..... 49/320; 49/306; 49/316; 49/318; 49/321

(58) Field of Classification Search ..... 49/303, 49/306, 307, 308, 316, 318, 319, 320, 321, 49/366, 368
See application file for complete search history.

(56) References Cited

U.S. PATENT DOCUMENTS

| | | | | |
|---|---|---|---|---|
| 724,139 | A | 3/1903 | Smith | |
| 1,995,939 | A | 3/1935 | Osten | |
| 2,552,369 | A | 5/1951 | Currie | |
| 2,862,262 | A | 12/1958 | Shea | |
| 3,004,309 | A | 10/1961 | Korodi | |
| 3,070,856 | A | 1/1963 | Minick | |
| 3,077,644 | A * | 2/1963 | Kesling | 49/366 |
| 3,098,519 | A | 7/1963 | Meyer et al. | |
| 3,383,801 | A | 5/1968 | Dallaire | |

(Continued)

OTHER PUBLICATIONS

Patio Life—Operation; http://www.rotohardware.com/Products/Patio%20Life/PL-Operation.htm.

*Primary Examiner*—Jerry Redman
(74) *Attorney, Agent, or Firm*—Scott D. Paul, Esq.; Steven M. Greenberg, Esq.; Carey, Rodriguez, Greenberg & Paul, LLP

(57) ABSTRACT

A combined sealing system and seal activation system for use with a double door/window system having a first panel and a second panel includes a first sealing system and a first seal activation system. The first sealing system is positioned within a meeting stile of the first panel, and the first seal activation system activates the first sealing system. The first sealing activation system is also positioned within a meeting stile of the second panel and includes a movable member configured to engage the first sealing system. The first sealing system includes a movable member, and movable member of the first sealing system is caused to move towards the second panel by the first sealing system being engaged by the movable member of the first seal activation system moving towards the first panel. The first panel and the second panel separately pivot relative to a frame surrounding the double door/window system.

8 Claims, 16 Drawing Sheets

U.S. PATENT DOCUMENTS

| | | | | |
|---|---|---|---|---|
| 3,466,801 | A | 9/1969 | Bohn | |
| 3,590,531 | A * | 7/1971 | Childs | 49/368 |
| 3,660,940 | A * | 5/1972 | Tavano | 49/366 |
| 3,818,636 | A | 6/1974 | Calais et al. | |
| 3,857,199 | A | 12/1974 | Frach et al. | |
| 3,959,927 | A * | 6/1976 | Good | 49/368 |
| 4,413,446 | A | 11/1983 | Dittrich | |
| 4,535,563 | A | 8/1985 | Mesnel | |
| 4,870,909 | A | 10/1989 | Richter | |
| 4,936,049 | A | 6/1990 | Hansen | |
| 5,007,202 | A | 4/1991 | Guillon | |
| 5,029,911 | A | 7/1991 | Daniels | |
| 5,339,881 | A | 8/1994 | Owens | |
| 5,349,782 | A * | 9/1994 | Yulkowski | 49/366 |
| 5,870,859 | A | 2/1999 | Kitada | |
| 6,082,047 | A | 7/2000 | Comaglio et al. | |
| 6,173,533 | B1 | 1/2001 | Cittadini et al. | |
| 6,243,999 | B1 | 6/2001 | Silverman | |
| 6,289,643 | B1 | 9/2001 | Bonar | |
| 6,442,899 | B1 | 9/2002 | Gledhill | |
| 6,490,832 | B1 | 12/2002 | Fischbach et al. | |
| D470,252 | S | 2/2003 | Castrey | |
| 6,644,884 | B2 | 11/2003 | Gledhill | |
| 6,651,389 | B2 | 11/2003 | Minter | |
| 2005/0097842 | A1 | 5/2005 | Arcamonte et al. | |

* cited by examiner

COMBINED SEALING SYSTEM AND SEAL ACTIVATION SYSTEM FOR DOOR

CROSS-REFERENCE TO RELATED APPLICATIONS

This application is a Continuation-In-Part of U.S. application Ser. No. 11/322,953, filed on Dec. 30, 2005, incorporated herein by reference in its entirety. This application is related to U.S. application Ser. No. 11/425,383, filed on Jun. 20, 2006, and to U.S. application Ser. No. 11/425,384, filed on Jun. 20, 2006.

BACKGROUND OF THE INVENTION

1. Field of the Invention

The disclosure relates generally to sealing systems for use with panels, such as a door or a window, within a frame and, more specifically, to a sealing system for providing an improved seal between a panel and frame.

2. Description of the Related Art

Certain types of panels, such as doors and windows, are positioned within openings of a wall and/or other structures using a frame. These panels may also open and close by pivoting relative to the frame. An issue associated with these types of panels is the integrity of the seals between the panels and the frame. In many instances, these seals are an insufficient barrier in preventing the transfer of such environmental elements as noise, weather, water, and insects from one side of the panel to the other side.

Attempts have been made to address these issues by using various types of weather stripping between the panels and frame. For example, the weather stripping may be strip of felt, foam, or a pile of flexible synthetic material. In many instances, however, this weather stripping fails to act as a sufficient seal between the panels and frame. Another issue prevalent associated with the seals between a frame and panel or between adjacent panels is that these seals can become disjoined. Either intentionally or unintentionally, the alignment between the frame and panel or between adjacent panels may be disturbed which can degrade the quality of the seal, since, in many instances, the integrity of the seal relies upon these members having certain positional relationships relative to one another.

There is, therefore, also a need for a sealing system that maintains the positional relationships between the frame and panel. A need also exists for a sealing system that can be employed between a frame and panel that prevents the transfer from one side of the panel to the other side of the panel such environmental effects as noise, weather, water, heat/cold, and insects

BRIEF SUMMARY OF THE INVENTION

Embodiments of the invention address deficiencies of the art with respect to effectively creating a seal between a panel and a frame. In this regard, a combined sealing system and seal activation system for use with a double door/window system having a first panel and a second panel includes a first sealing system and a first seal activation system. The first sealing system is positioned within a meeting stile of the first panel, and the first seal activation system activates the first sealing system. The first sealing activation system is also positioned within a meeting stile of the second panel and includes a movable member configured to engage the first sealing system. The first sealing system includes a movable member, and movable member of the first sealing system is caused to move towards the second panel by the first sealing system being engaged by the movable member of the first seal activation system moving towards the first panel. The first panel and the second panel separately pivot relative to a frame surrounding the double door/window system.

In certain aspects of the combined sealing system and seal activation system, the first sealing system includes a rocker arm pivotally connected to the first panel, and an anchor pivotally connected to the rocker. Movement of a portion of the rocker arm away from the second panel moves the anchor towards the second panel. The first seal activation system includes a first cam pivotally connected to the second panel, and a first activation pin pivotally connected to the first cam. The anchor of the first sealing system is caused to move towards the second panel by the first sealing system being engaged by the first activation pin moving towards the first panel.

In other aspects of the combined sealing system and seal activation system, a plurality of sealing systems are provided to respectively connect all pairs of adjacent sides of the frame and the first and second panels. Also, the first sealing system provides a seal substantially, entirely between the meeting stile of the first panel and the meeting stile of the second panel. In a locked configuration of the first sealing system, the anchor engages a portion of the second panel to form a seal between the first panel and the second panel and to prevent movement of the first panel relative to the second panel.

In further aspects of the combined sealing system and seal activation system, a second sealing system is positioned within the frame, and the second seal activation system activates the second sealing system and is positioned within the second panel on one side of the second panel. The first sealing activation system is positioned within the second panel on another side of the second panel different than the one side of the second panel. The first cam and a second cam of the second activation system are interconnected via at least one cam connecting member, and positioning the first seal activation system to an engaged configuration causes positioning of all seal activation systems to an engaged configuration.

In yet other aspects of the combined sealing system and seal activation system, a second sealing system is positioned within the frame, and the first seal activation system activates the second sealing system. The first sealing system includes an extension arm pivotally connected to the rocker arm and is configured to transfer motion of the first activation pin to the rocker arm. A plurality of rocker arms are connected to the anchor, and in the locked configuration of the first sealing system, the first activation pin extends through the anchor.

In still other aspects a combined sealing system and seal activation system is provided for use with a first panel of a door/window system. The combined system includes a first seal activation system positioned within the first panel, and a second sealing system positioned within the first panel. The first seal activation system activates a first sealing system positioned within a frame surrounding the door/window system. Also, the first seal activation system has an engaged configuration and a disengaged configuration while the first panel is positioned within the frame. The second sealing system creates a seal between the first panel and one of a second panel and the frame, and the second sealing system having a locked configuration and an unlocked configuration while the first panel is positioned within the frame.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
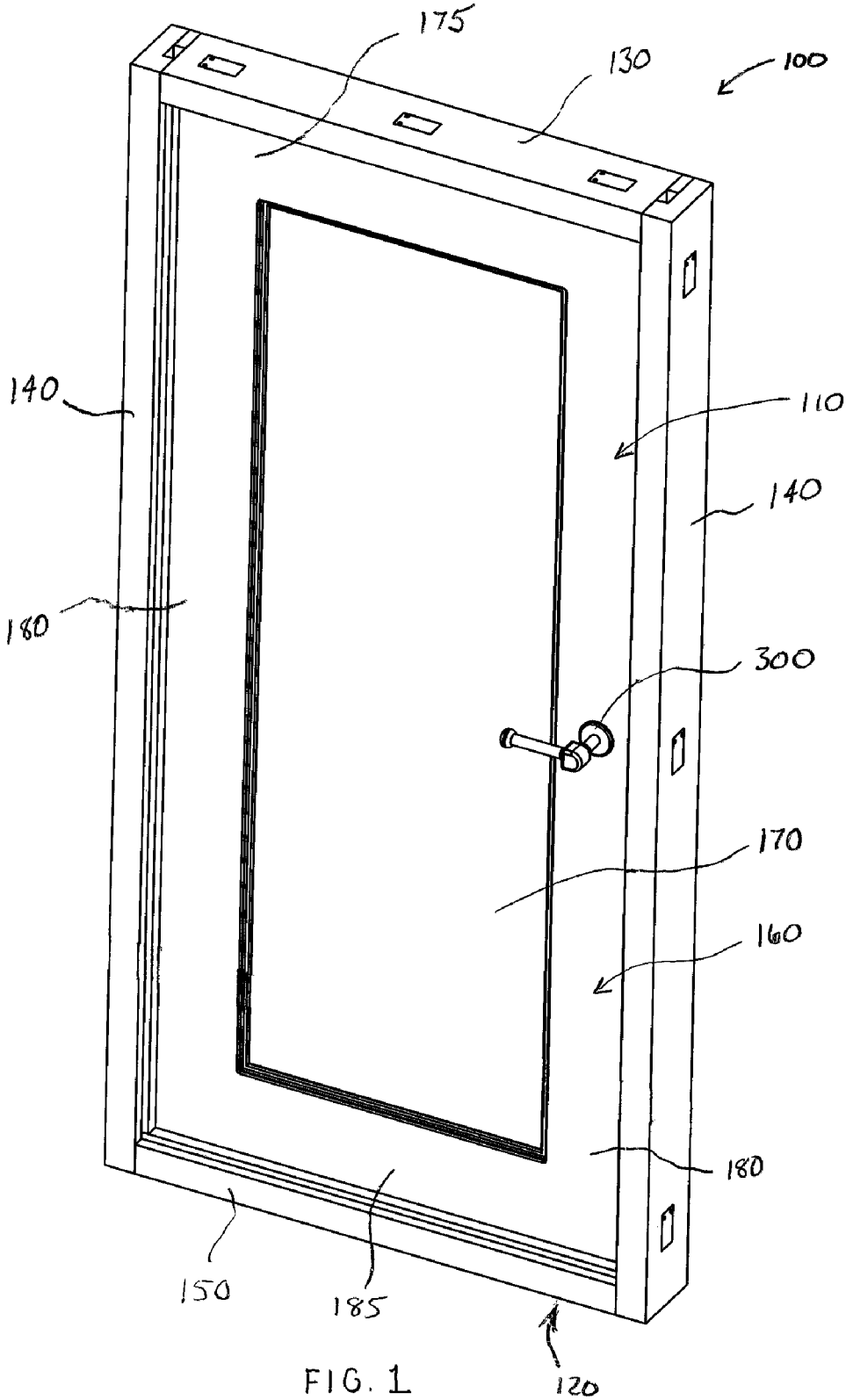
FIG. 1 is a perspective view of a door/window system in a closed position in accordance with the inventive arrangements.
Figure 2:
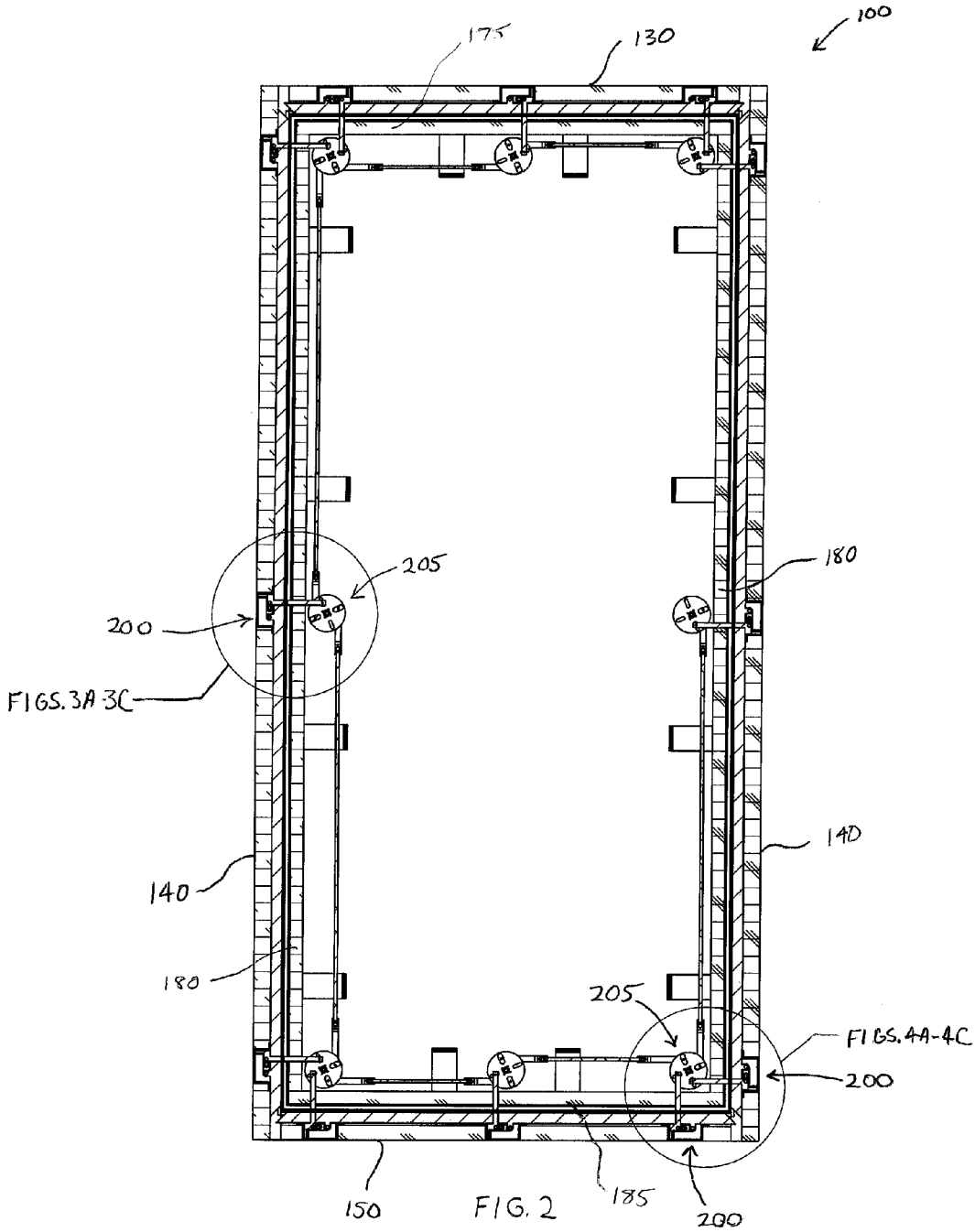
FIG. 2 is a front, partial cross-sectional view of the door/window system in accordance with the inventive arrangements.
Figure 3A:
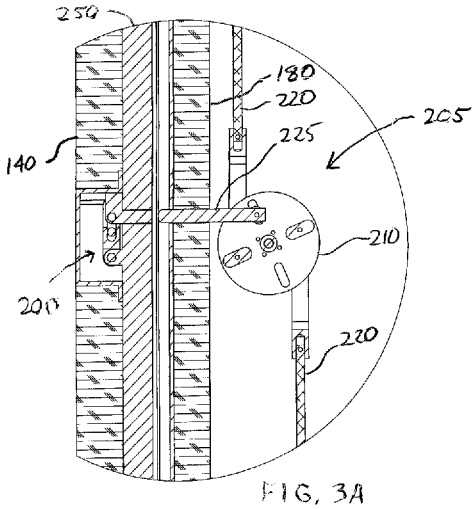
FIGS. 3A-3C are isolated detail views of the combination sealing system and seal activation system in accordance with the inventive arrangements at a side of the door/window system, respectively, in the unlocked, partially engaged, and locked configurations.
Figure 3B:
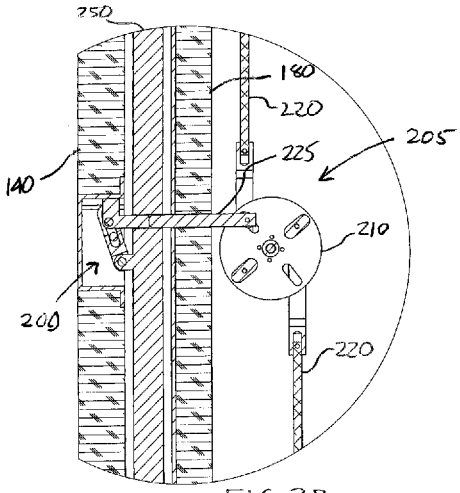
Figure 3C:
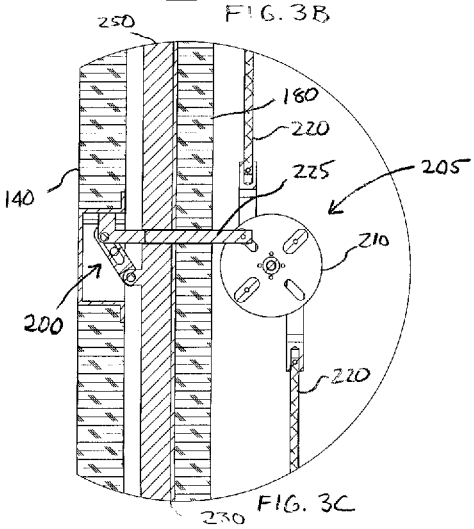

FIG. 1 illustrates an exemplar door/window system 100 for use with the combination sealing system 200 and seal activation system 205. The combination sealing system 200 and seal activation system 205 can be used with many types of doors and/or windows, and the combination sealing system 200 and seal activation system 205 is not limited to the particular door/window system 100 illustrated. For example, the combination sealing system 200 and seal activation system 205 may be used with pocket doors, sliding doors, French doors, entry doors, garage doors, sliding windows, single-hung windows, double-hung windows, casement windows, and awning windows. The door/window system 100 includes at least one panel 110 connected to a stationary frame 120. Although not limited in this manner, the panel 110 may pivot relative to the frame 120.

The frame 120 may include a header 130, jambs 140, and a sill 150. A header 130 is a structural member that spans an upper portion of the window/door opening. Jambs 140 are the outermost vertical side members of the frame 120. A sill 150 is a threshold or structural member that spans a lower-most portion of the window/door opening. As recognized by those skilled in the art, different terms may also be associated with the above-structure identified as the header 130, jambs 140, and sill 150.

The panel 110 may include a sash 160 that surrounds a pane 170. The pane 170 is not limited as to a particular material. For example, the pane 170 may be translucent, such as glass or plastic, opaque, such as with wood or metal, or any combination thereof. The sash may include a header rail 175, jamb or stile rails 180, and a sill rail 185. As recognized by those skilled in the art, different terms may also be associated with the structure identified as the header rail 175, the jamb or stile rail 180, and sill rail 185.

Referring to FIGS. 2, 3A-3C, and 4A-4C, the combination sealing system 200 and seal activation system 205 may be used with each of the members 175, 180, 185 of the sash 160 to form a seal 230 (see FIGS. 3C, 4C) between each pair of adjacent surfaces of the sash 160 of the panel 110 and the frame 120. In this manner, each of the separate sides of the panel 110 may employ the combination sealing system 200 and seal activation system 205. As will be described in more detail below, not only does the combination sealing system 200 and seal activation system 205 provide at least one seal between adjacent members of sash 160 and frame 120, the combination sealing system 200 and seal activation system 205 may be configured to prevent the movement of the panel 110 relative to the frame 120. In so doing, the combination sealing system 200 and seal activation system 205 can act as a lock and/or security device that prevents the forced opening of the panel 110 relative to the frame 120. Many types of sealing systems 200 and seal activation systems 205 so capable are known in the art, and the present door/window system 100 is not limited as to a particular type of sealing system 200 or sealing activation system 205.

Although the present door/window system 100 is described herein with particular types of sealing systems 200 being positioned in particular locations in the frame 120, the door/window system 100 is not limited as to a particular type of sealing system 200 and/or a particular location of the sealing system 200 within the frame 120. Additionally, although the present door/window system 100 is described herein with particular types of seal activation systems 205 being positioned in particular locations in the panel 110, the door/window system 100 is not limited as to a particular type of seal activation system 205 and/or a particular location of the seal activation system 205 within the panel 110.

To prevent the forced opening of the panel 110, the sealing systems 200 are not limited as to a percentage of coverage between particular members of the frame 120 and/or panel 110. For example, the sealing systems 200 may only cover a fractional number (e.g., 10%, 50%, 85%) of the length between particular members of the frame 120 and/or panel 110. However, in certain aspects, the sealing systems 200 provide substantially complete coverage between the sash 160 of a panel 110 and the frame 120. In so doing, the combined sealing systems 200 can provide a seal substantially, completely around the panel 110.

Figure 10A:
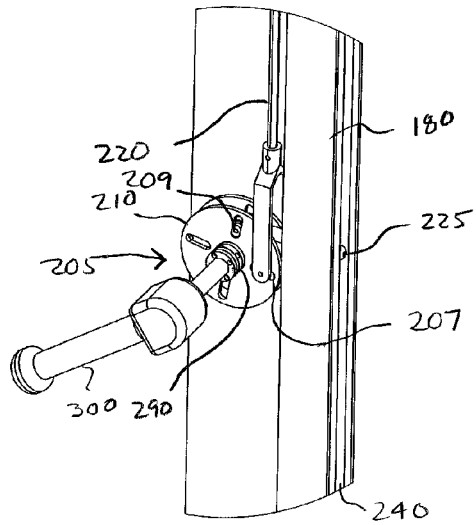
FIGS. 10A-10C are isolated detail views of the seal activation system in accordance with the inventive arrangements at another side of the panel, respectively, in the unlocked, partially engaged, and locked configurations.
Figure 9B:
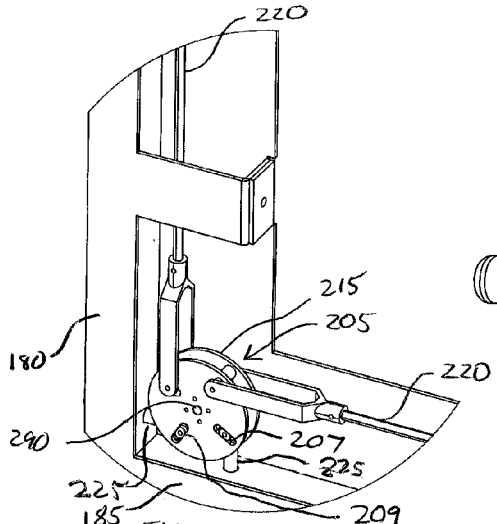
Figure 10B:
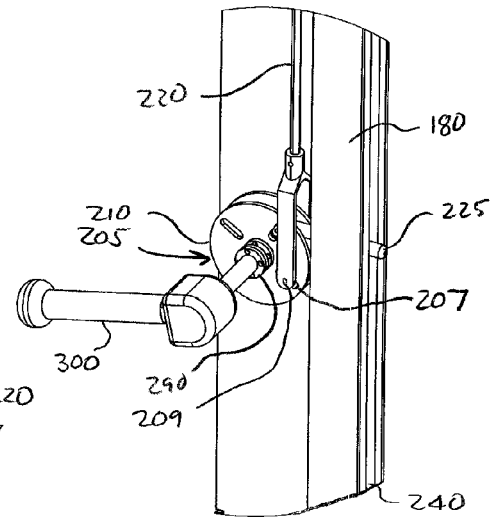
Figure 9C:
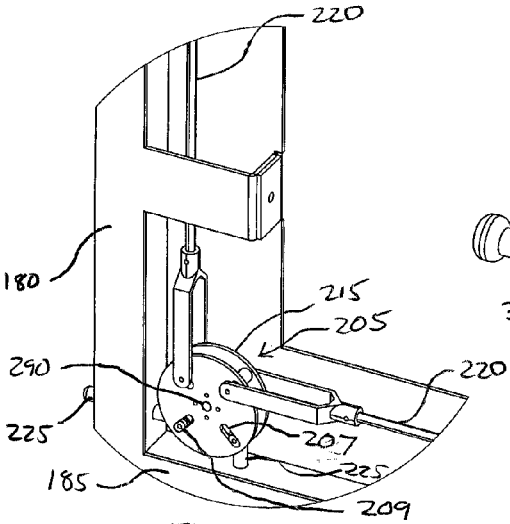
Figure 10C:
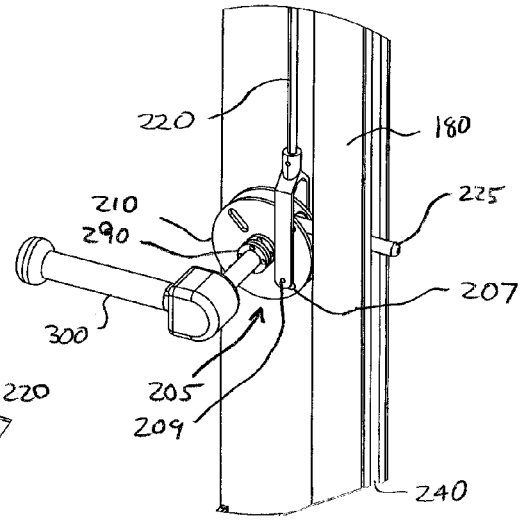
Figure 11:
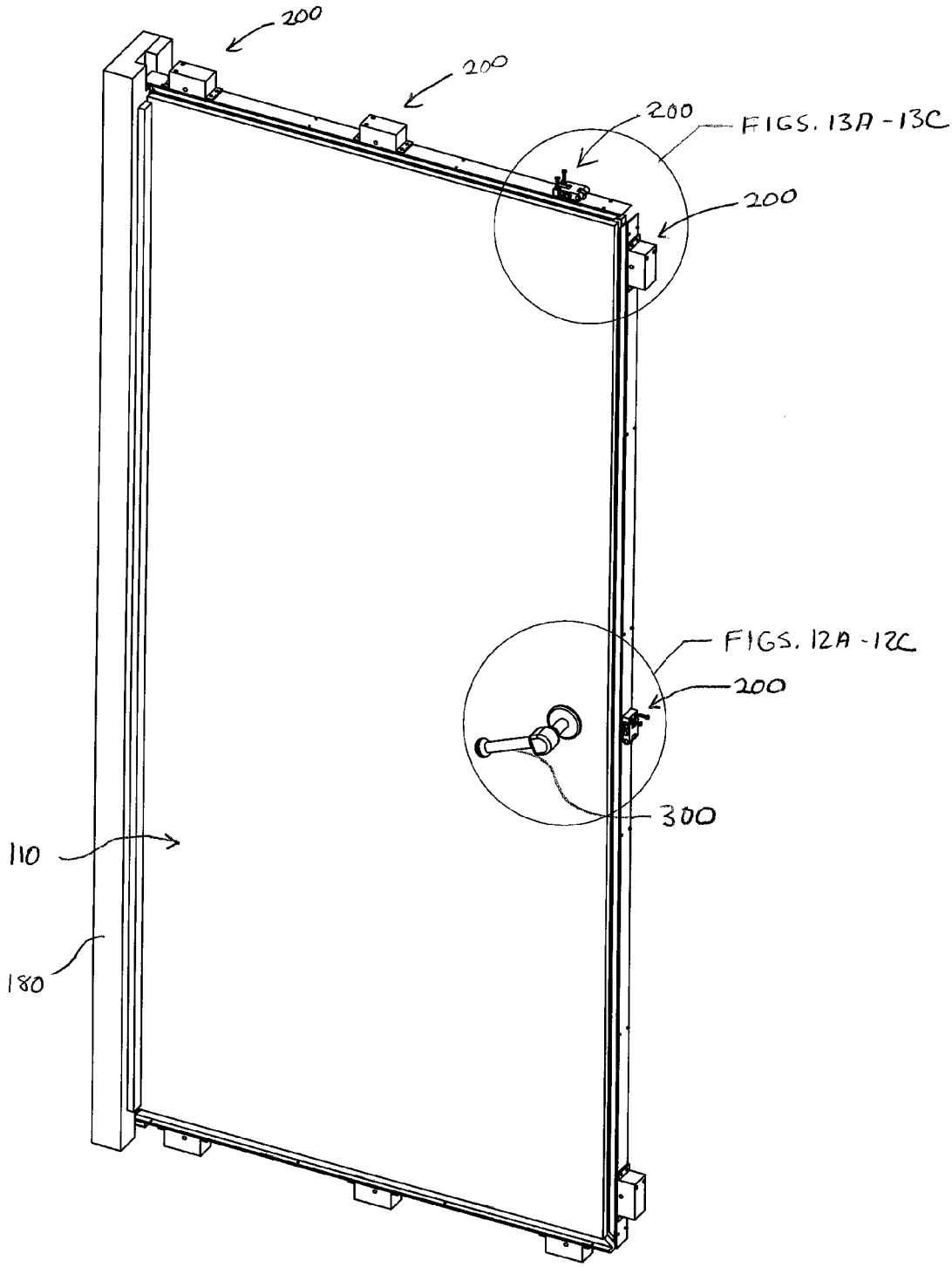
FIG. 11 is a perspective view of the panel of the door/window system and a partial perspective view of the frame and the sealing system in accordance with the inventive arrangements.
Figure 12A:
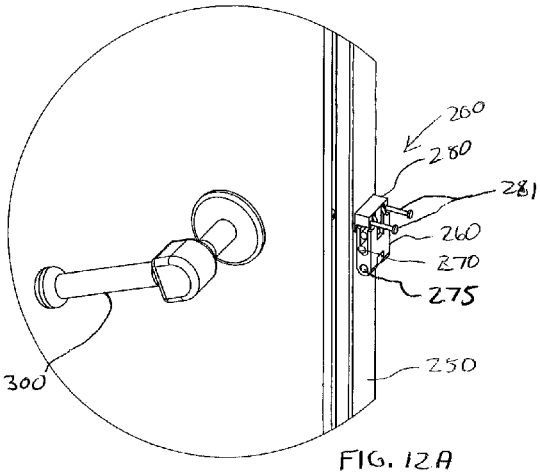
FIGS. 12A-12C are isolated detail views of the sealing system in accordance with the inventive arrangements and the closing system at a side of the frame, respectively, in the unlocked, partially engaged, and locked configurations.
Figure 12B:
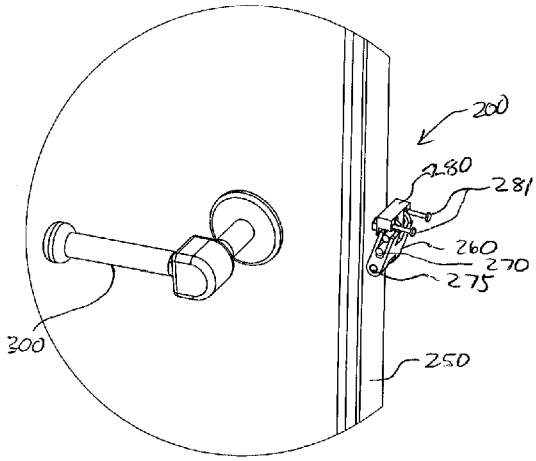
Figure 12C:
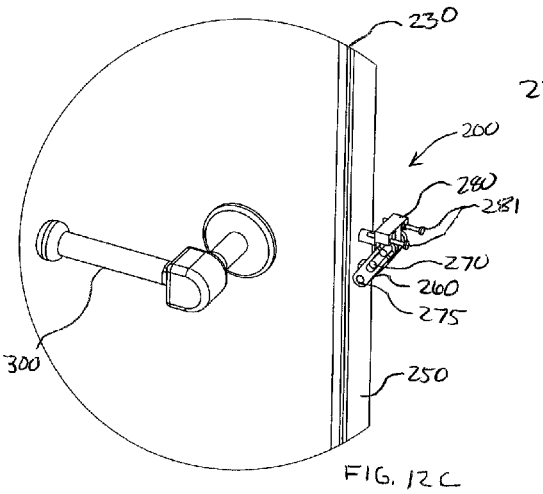

A closing system 300 moves the seal activation system 205 from the deactivated configuration (see FIG. 10A) to an activated configuration (see FIG. 10C). The closing system 300 may also move the seal activation system 205 from the activated configuration to the deactivated configuration. How the closing system 300 moves the seal activation system 205 from the deactivated configuration to the activated configuration (and back again) is not limited as to a particular manner and/or device. As can be readily envisioned, the configuration and operation of the closing system 300 may be determined by the configuration and operation of the seal activation system 205. A present example of the sealing system 300 employs the use of a door handle to rotate a portion of one of the seal activation system 205. Although this closing system 300 is shown as being manually operated, other devices capable of moving a seal activation system 205 are commonly known, such as magnetic, mechanical, and electro-mechanical devices.

FIGS. 6, 7A-7C, 8A-8C, 9A-9C, and 10A-10C further illustrate details of the seal activation systems 205. The seal activation systems 205 may be positioned within the sash 160 and/or the pane 170 of the panel 110. In certain aspects of the door/window system 100, the seal activation system 205 may interact with one or more sealing systems 200 within the frame 120. These sealing systems 200, in turn, may interact with the panel 110 to provide at least one seal 230 between adjacent members of the sash 160 of the panel 110 and the frame 120 in a locked configuration, and/or the sealing system 200 may interact with the panel 110 to prevent the movement of the panel 110 relative to the frame 120 in the locked configuration. In an unlocked configuration, the sealing system 200 may not provide the seal 230 and/or prevent movement of the panel 110 relative to the frame 120. Many types of sealing activation system 205 capable of this type of interaction with a sealing system 200 are known in the art, and the present door/window system 100 is not limited as to a particular type of sealing activation system 205 so capable.

At least one of the seal activation systems 205 may include at least one cam 210, 215. Although not limited in this manner, the cam 210, 215 can be fixed in position relative to the panel 110 by being rotated about a cam pivot 290 connected to the panel 110. Upon being rotated, the cam 210, 215 causes the movement of at least one activation pin 225. For example, upon being rotated in one direction, the cam 210, 215 may cause the movement of the activation pin 225 away from the sash 160, and upon being rotated in the opposite direction, the cam 210, 215 may cause the movement of the activation pin 225 towards the sash 160. Either directly or indirectly, depending upon the type of movement of the activation pin 225, the activation pin 225 positions the sealing system 200 in the locked configuration and/or the unlocked configuration.

Each cam 210 may move a single or multiple activation pins 225. For example, as illustrated in the drawings, a side cam 210 may be connected to single activation pin 225. As another example, a corner cam 215, by being positioned in a corner of the panel 110, may be connected to two activation pins 225 with each activation pin 225 extending from separate sides of the sash 160.

Although not limited in this manner, multiple cams 210, 215 may be provided along a single side of the sash 160. In so doing, the multiple cams 210, 215 may cause the activation of multiple sealing systems 200 positioned within a single side of the frame 120 adjacent the single side of the sash 160.

The seal activation system 205 may also include one or more cam connecting members 220 for interconnecting some or all of the cams 210, 215. In this manner, rotation of one of the cams 210, for example by the closing system 300, causes the other cams 210 to rotate. A single closing system 300 may be configured to simultaneously move each of separate seal activation systems 205 via, for example, use of the cam connecting members 220. However, in other aspects of the door/window system 100, multiple closing systems 300 may be provided to separately close one or multiple seal activation systems 205.

Both the cam connecting member 220 and/or the activation pin 225 may be connected to the cams 210, 215 via separate cam slot pivots 209. The cam slot pivot 209 may also allow the cam connecting member 220 and the activation pin 225 to pivot relative to the cams 210, 215. The cams 210, 215 may also include a cam slot 207 through which the cam slot pivot 209 may extend. The cam slot 207 allows the cam slot pivot 209 connecting the cams 210, 205 to either the activation pin 225 or the cam connecting member 220 to laterally slide relative to the cam 210, 215. As the cams 210, 215 rotate, the angular and/or positional relationship between the cams 210, 215 and the activation pin 225 and/or the cam connecting member 220 change. The cam slot 207 allows for easier pivoting of the cams 210, 215 relative to the activation pin 225 and/or the cam connecting member 220 by providing the cam slot pivot 209 additional positional flexibility.

Although the combination of cams 210, 215, cam connecting members 220, and activation pins 225 described and illustrated are one example of how a seal activation system 205 within the panel 110 may activate a sealing system 220 within the frame 120, the door/window system 100 is not limited in this particular manner. As can be readily envisaged by one skilled in the art, other types of linkages systems may be employed to act as a seal activation system 205 within the panel 110 to activate the sealing system 220 within the frame 120.

Figure 5A:
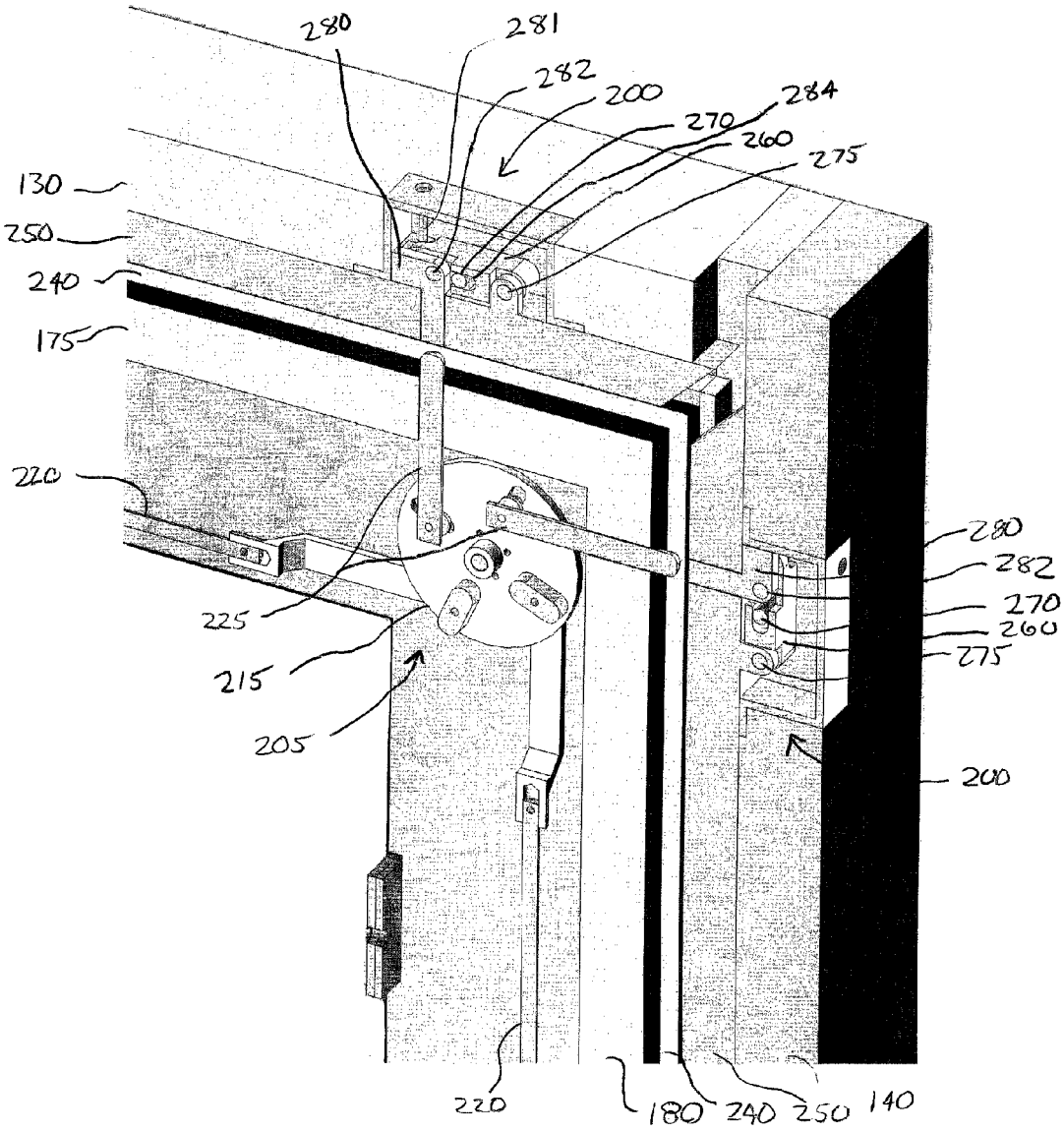
FIGS. 5A-5C are perspective views of the combination sealing system and seal activation system in accordance with the inventive arrangements at a corner of the door/window system, respectively, in the unlocked, partially engaged, and locked configurations.
Figure 5B:
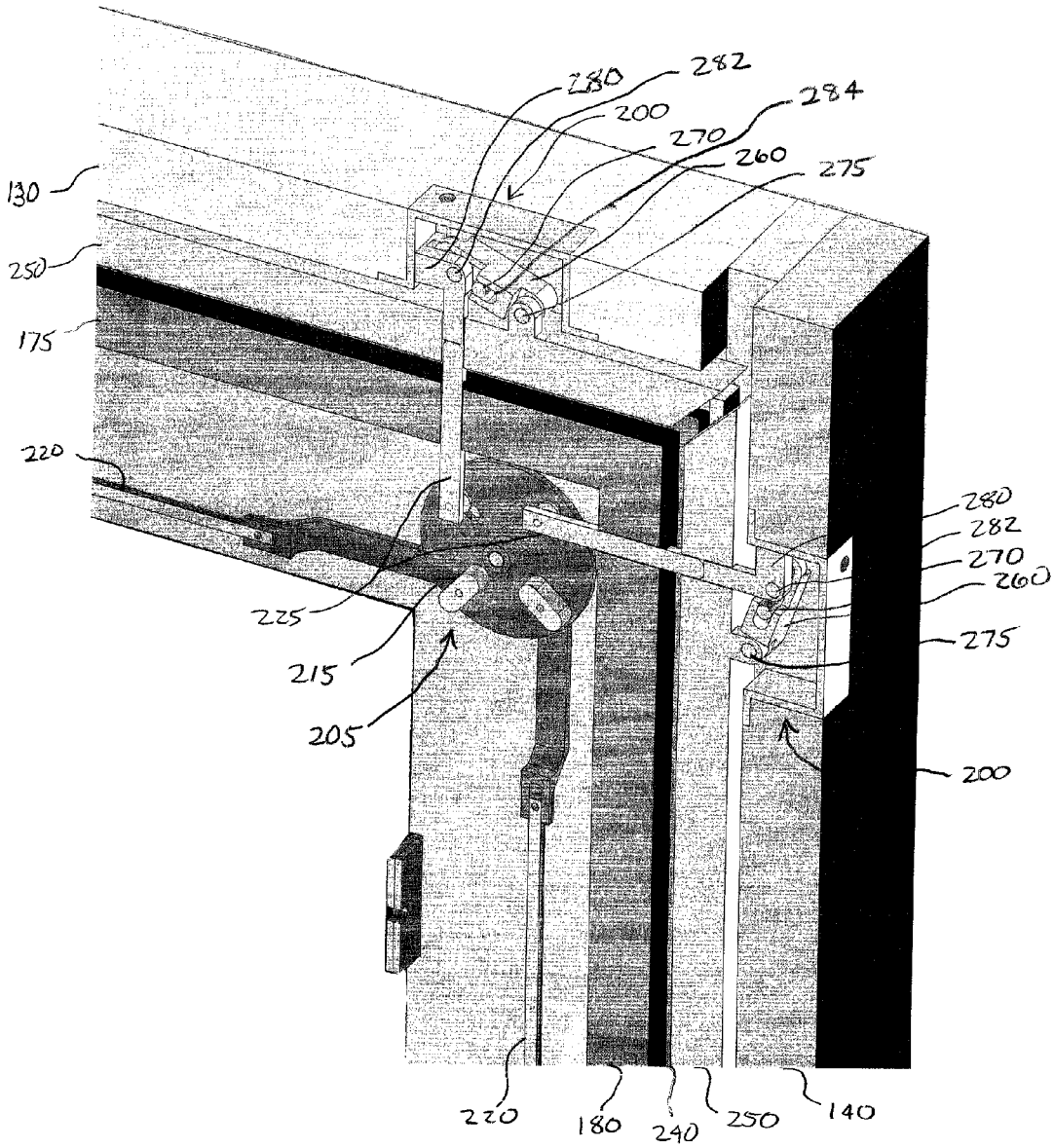
Figure 5C:
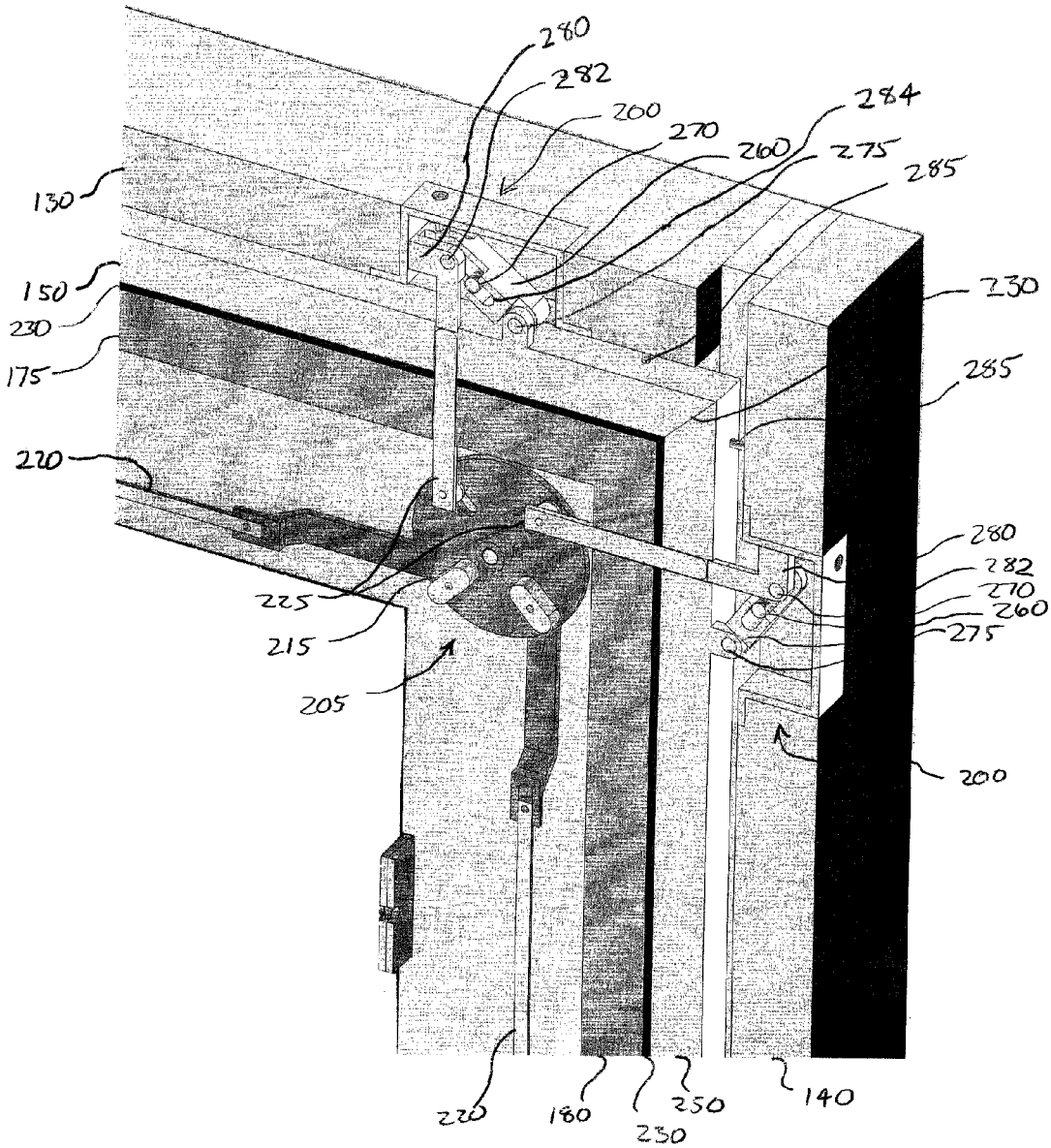
Figure 6:
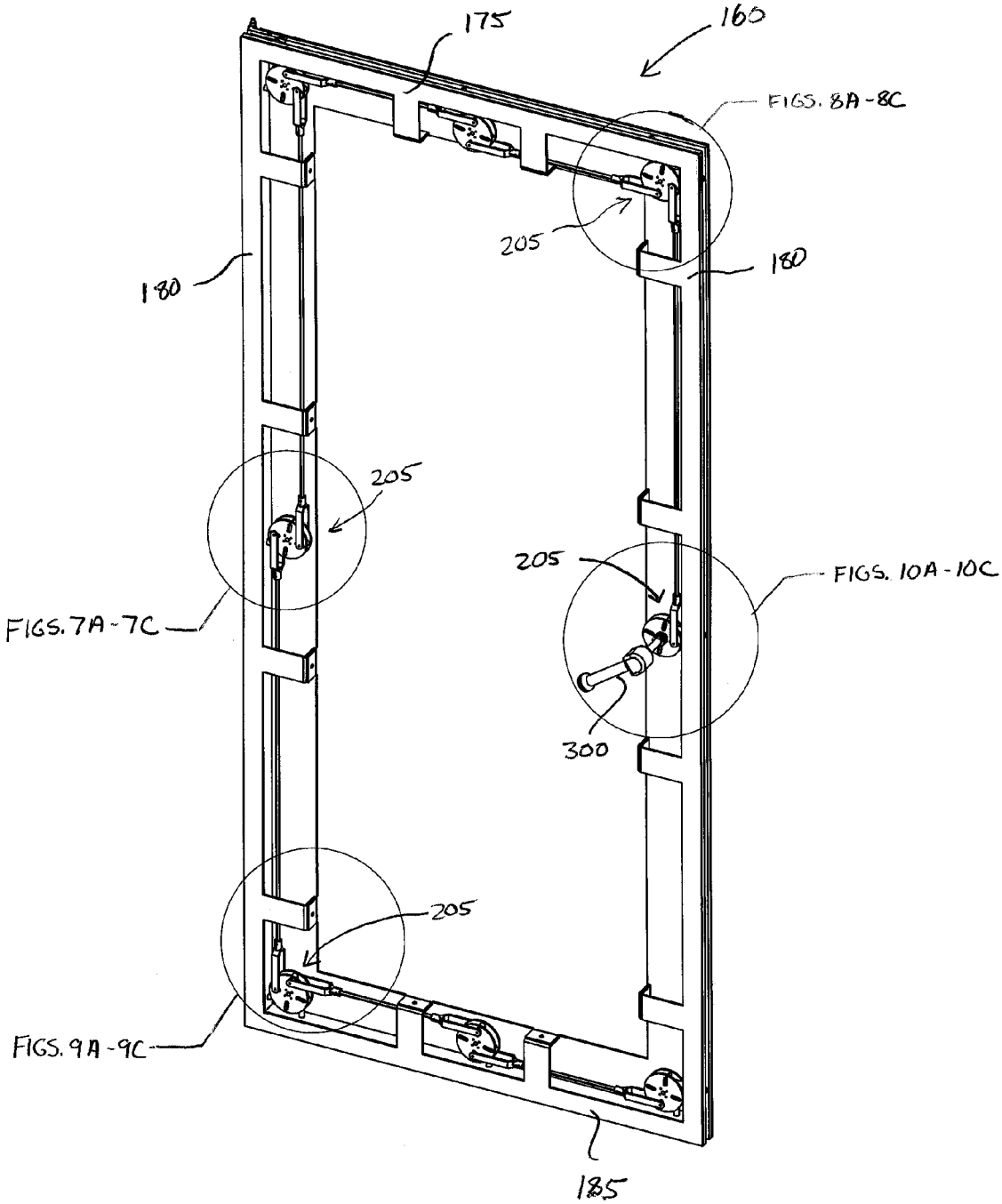
FIG. 6 is a perspective view of the panel of the door/window system in accordance with the inventive arrangements.
Figure 7A:
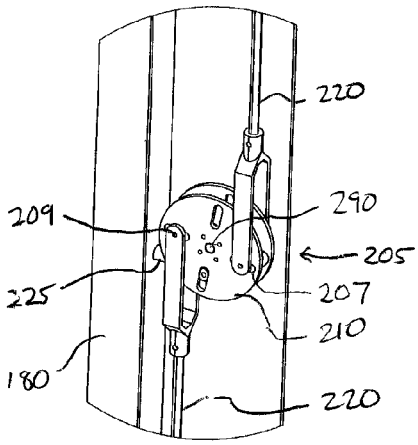
FIGS. 7A-7C are isolated detail views of the seal activation system in accordance with the inventive arrangements at one side of the panel, respectively, in the unlocked, partially engaged, and locked configurations.
Figure 8A:
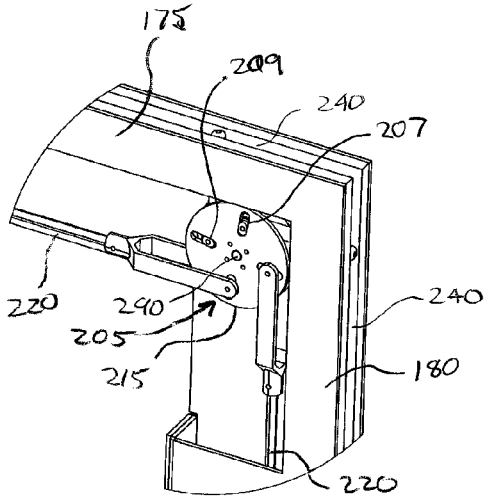
FIGS. 8A-8C are isolated detail views of the seal activation system in accordance with the inventive arrangements at one corner of the panel, respectively, in the unlocked, partially engaged, and locked configurations.
Figure 7B:
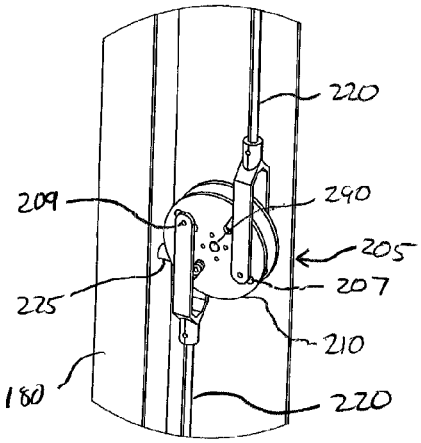
Figure 8B:
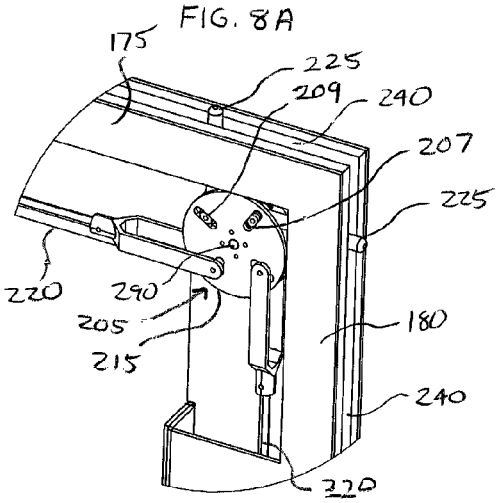
Figure 7C:
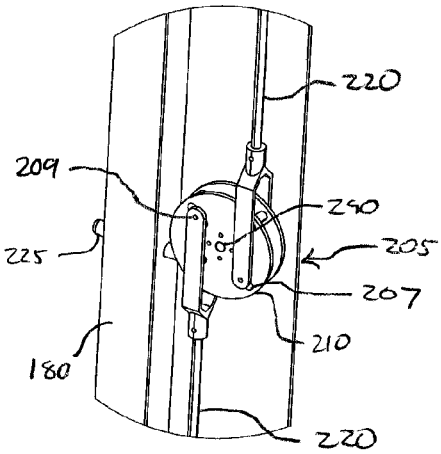
Figure 8C:
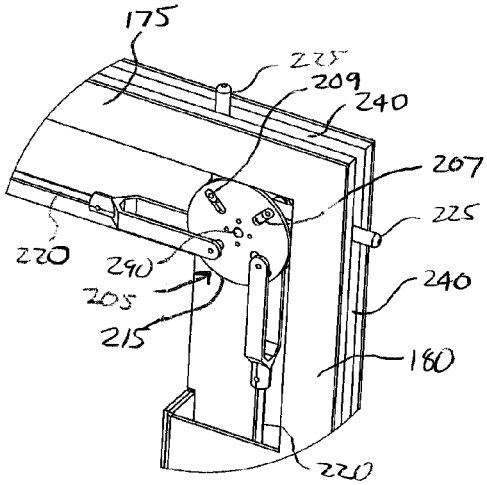
Figure 9A:
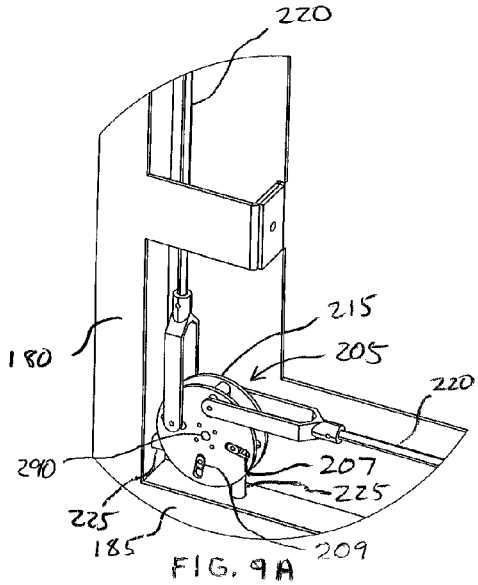
FIGS. 9A-9C are isolated detail views of the seal activation system in accordance with the inventive arrangements and a closing system at another corner of the panel, respectively, in the unlocked, partially engaged, and locked configurations.

FIGS. 11, 12A-12C, and 13A-13C further illustrate details of the sealing systems 200. Reference is also made to FIGS. 5A-5C, which illustrate the sealing system 200 used in conjunction with a seal activation system 205. The sealing systems 200 may be positioned within the frame 120 of the door/window system 100. In certain aspects of the door/ window system 100, the sealing system 200 may interact with the panel 110 to provide at least one seal 230 between adjacent members of the sash 160 of the panel 110 and the frame 120 in a locked configuration, and/or the sealing system 200 may interact with the panel 110 to prevent the movement of the panel 110 relative to the frame 120 in the locked configuration. In an unlocked configuration, the sealing system 200 may not provide the seal 230 and/or prevent movement of the panel 110 relative to the frame 120. Many types of sealing systems 200 capable of one or more of these functions are known in the art, and the present door/window system 100 is not limited as to a particular type of sealing system 200 so capable. However, in certain aspects of the door/window system 100, the sealing system 200 provides both of these functions.

In certain aspects of the sealing system 200, the sealing system 200 employs the use of reciprocal motion device to form a seal 230 between adjacent members of sash 160 and the frame 120. The seal 230 is formed by engagement of an anchor 250 of the sealing system 200 with a portion of the sash 160. Although the sealing system 200 is not limited as to the particular portion of the sash 160 with which the anchor 250 engages to form the seal 230, in certain aspects of the sealing system 200, the seal 230 engages a surface of a slot 240 within members (e.g., header rail 175, stile rail 180, and sill rail 185) of the sash 160. Also, by having the anchor 250 being positioned with slot 240, movement of the panel 110 relative to the frame 120 can be prevented.

Figure 4A:
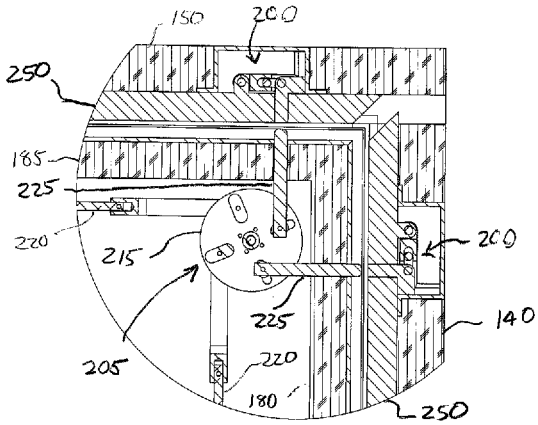
FIGS. 4A-4C are isolated detail views of the combination sealing system and seal activation system in accordance with the inventive arrangements at a corner of the door/window system, respectively, in the unlocked, partially engaged, and locked configurations.
Figure 4B:
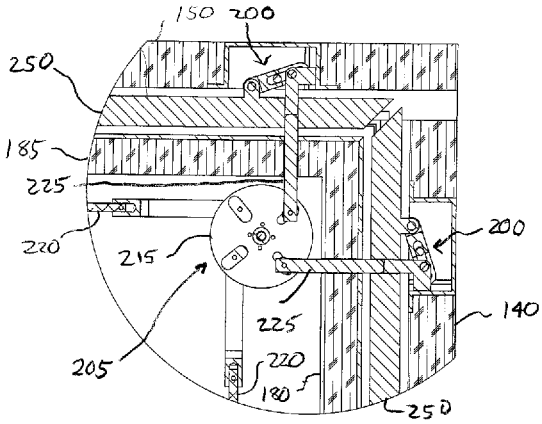
Figure 4C:
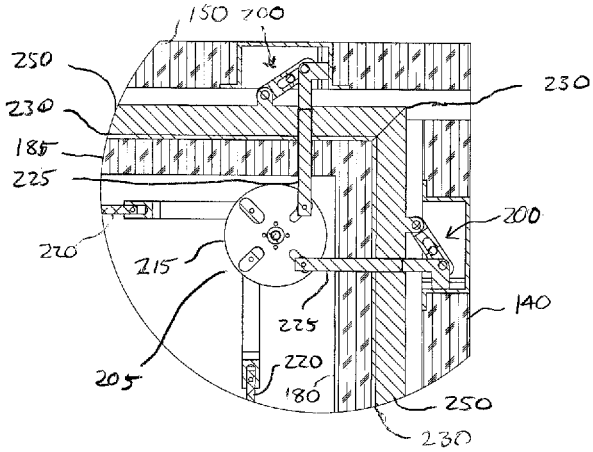
Figure 13A:
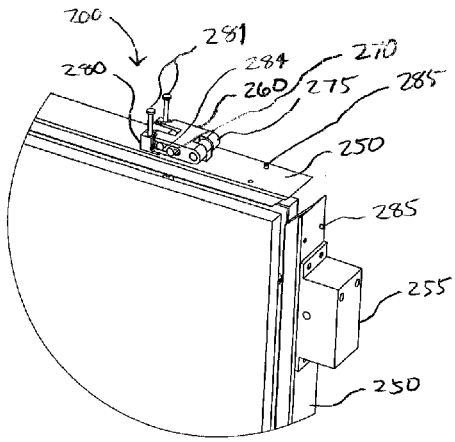
FIGS. 13A-13C are isolated detail views of the sealing system in accordance with the inventive arrangements at a corner of the frame, respectively, in the unlocked, partially engaged, and locked configurations.
Figure 13B:
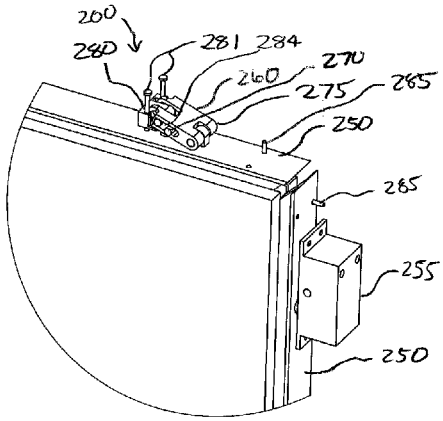
Figure 13C:
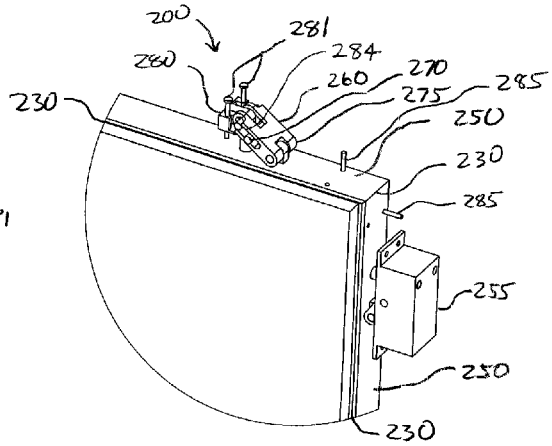

Additionally, as shown in FIGS. 4C, 5C, and 13C, a seal 230 may be formed by adjacent anchors 250 inter-engaging one another. In this manner, all the anchors 250 may be interconnected and surround the panel 110. The manner in which the anchors 250 inter-engage one another is not limited as to a particular configuration or device. However, in certain aspects, the adjacent anchors 250 include angled surfaces at their distal ends that mate with one another.

One or more anchor guides 285 may extend from the frame 120 and through the anchor 250. In so doing, the anchor guide 285 can guide movement of the anchor 250 along a predetermined path and prevent the anchor 250 from deviating from the predetermined path. This function of guiding the anchor 250 may also be provided by one or more activation pins 225 that extend from the sash 160. The activation pin 225 may be positioned to pass through the anchor 250 while engaging the sealing system 200 as will be described in greater detail below. In so doing, the activation pin 225 may also guide movement of the anchor 250 along a predetermined path and prevent the anchor 250 from deviating from the predetermined path.

The reciprocal motion device to form the seal 230 includes a pair of motions in opposite directions. For example, one of the motions may involve the movement of the anchor 250 substantially towards the sash 160, and the second of the motions may involve the movement of a portion of the sealing system 200 substantially away from the sash 160. The manner in which the reciprocal motion is created is not limited as to a particular device. For example, many types of linkages are known that are capable of transforming motion in one direction to direction in a substantially opposite direction.

In certain aspects of the sealing system 200, the reciprocal motion is created through the use of a rocker arm 260 that pivots about a rocker pivot 270. Although not limited in this manner, the rocker pivot 270 may be attached to a rocker housing 255 and/or the frame 120, and one side of the rocker arm 260 may be connected, either directly or indirectly, to the anchor 250. Although not limited in this manner, an anchor pivot 275 connects the rocker arm 260 to the anchor 250 and allows the rocker arm 260 to pivot relative to the anchor 250.

The movement of the anchor 250 may be accomplished through the use of repetitive portions of the sealing systems 200. For example, multiple rocker arms 260 may be attached to a single anchor 250. In so doing, the force used to move the anchor 250 may be balanced through the use of the multiple rocker arms 260.

Movement of the opposite side of the rocker arm 260 substantially away from the sash 160 creates the reciprocal movement of the side of the rocker arm 260 connected to the anchor 250 substantially towards the sash 160. This results in the anchor 250 moving substantially towards the sash 160. The sealing system 200 is not limited in the manner in which the opposite side of the rocker arm 260 is moved substantially away from the sash 160. Many types of devices so capable are known in the art, and the sealing system 200 is not limited as to a particular type of device so capable.

In certain aspects of the sealing system 200, however, the rocker arm 260 is configured to be moved by a movable member extending from the sash 160. The sealing system 200 is not limited as to a particular type of movable member extending from the sash 160 that is capable of moving the rocker arm 260 in a direction away from the sash 160; however, in certain aspects, the movable member is an activation pin 225. The movable member (e.g., the activation pin 225) may engage, either directly or indirectly, the rocker arm 260.

As illustrated in the figures, in a current aspect of the sealing system 200, an extension arm 280 may be provided to indirectly connect the rocker arm 260 to the movable member used to move the rocker arm 260. As shown in FIG. 5A, in the unlocked configuration, a distal end of the extension arm 280 may be positioned within the frame 120 so as to be substantially flush with a surface of the frame 120 proximate to the sash 160. For example, the extension arm 280 may be flush with the anchor 250. By having the distal end of the extension arm 280 substantially flush with the surface of the frame 120 proximate to the sash 160, the extension arm 280 does not extend beyond the surface, which could act as an obstruction. Also, the extension arm 280 does not create a hollow in the surface, which could act as a catch for debris while the sealing system 200 is in the unlocked configuration.

One or more extension guides 281 may extend from the frame 120 and through the extension arm 280. In so doing, the extension guides 281 can guide movement of the extension arm 280 along a predetermined path and prevent the extension arm 280 from deviating from the predetermined path. The extension guides 281 may also prevent the extension arm 280 from floating within the rocker housing 255 and/or maintain a desired relationship between the extension arm 280 and the rocker arm 260.

Although not limited in this manner, an extension arm pivot 282 connects the rocker arm 260 to the extension arm 280 and allows the extension arm 280 to pivot relative to the rocker arm 260. The rocker arm 260 may also include a rocker slot 284 through which the extension arm pivot 282 and/or the rocker pivot 270 may extend. The rocker slot 284 allows either the extension arm pivot 282 and/or the rocker pivot 270 to laterally slide relative to the rocker arm 260 and allow for easier pivoting of the rocker arm 260 relative to the extension arm 280 and/or the frame 120.

The sealing systems 200 are not limited as to the particular manner in which the sealing system 200 is positioned from the locked configuration to the unlocked configuration. For example, after the anchor 250 has been moved towards the sash 160 and the member has been withdrawn from engagement with the rocker arm 260, a resilient member (or other device) may move (either directly or indirectly) a portion of the rocker arm 260 attached to the anchor 250 away from the sash 160. In addition to or alternatively, the resilient member (or other device) may be directly connected to the anchor 250. As previously described, the engagement of one sealing system 200 may cause the engagement of one or more of the other sealing systems 200. In the same manner, the disengagement of one sealing system 200 may cause the disengagement of one or more of the other sealing systems 200.

Figure 14:
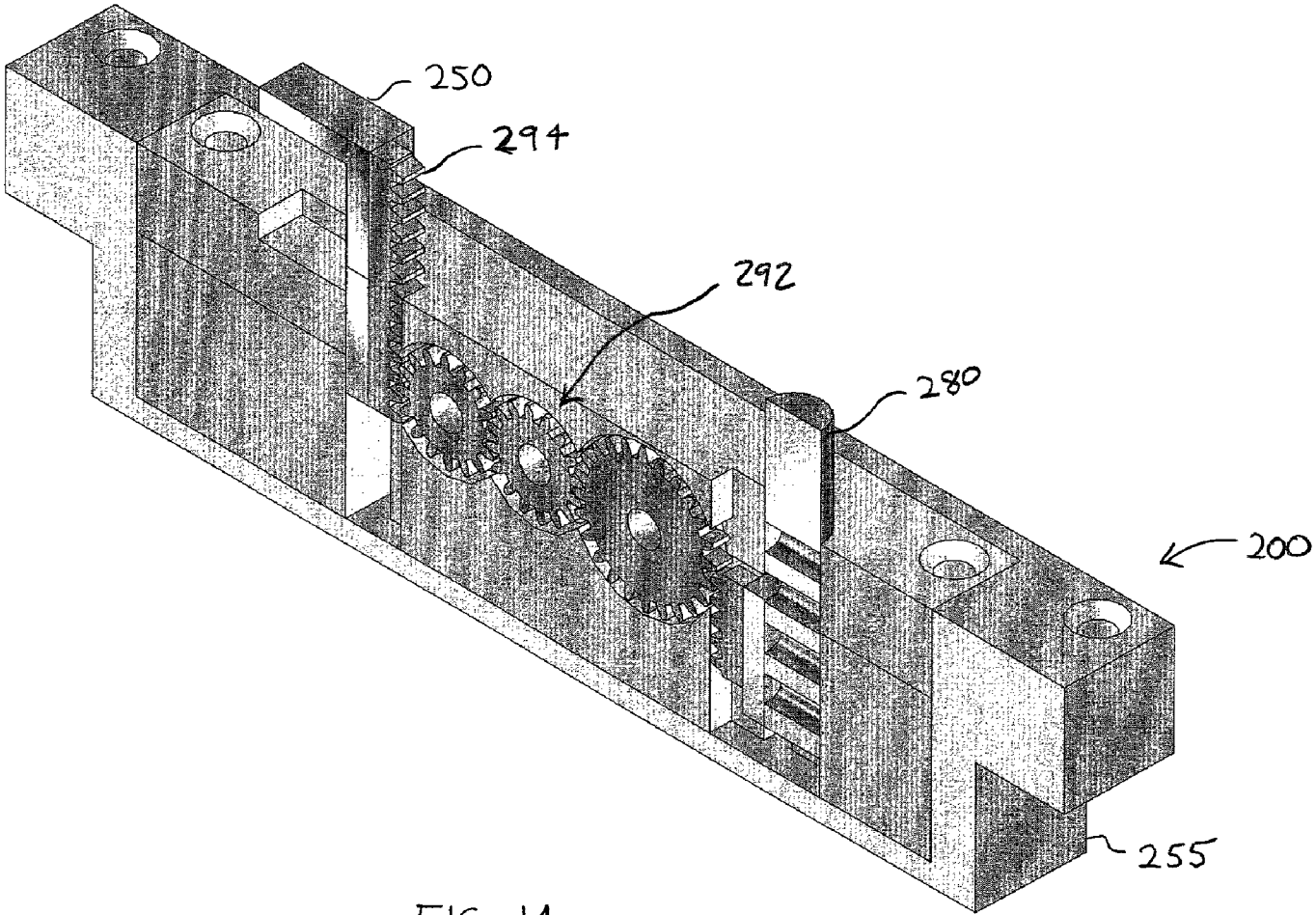
FIG. 14 is a perspective view of an alternative sealing system employing a reciprocal motion device in accordance with the inventive arrangements.

Another version of the sealing system 200 employing a reciprocal motion device is illustrated in FIG. 14. The sealing system 200 includes an extension arm 280 that indirectly connects a linkage 292 to the movable member (e.g., the activation pin 225) used to move the linkage 292. The linkage 292, as shown, includes a plurality of gears that transfer motion in one direction to motion in another direction. However, the linkage 292 is not limited in this manner as any device capable of transferring motion in one direction to motion in another direction is acceptable for use as the linkage 292. The motion from the movable member is transferred by the linkage 292 to a second extension arm 294 that is part of, or connected to, the anchor 250.

Figure 15A:
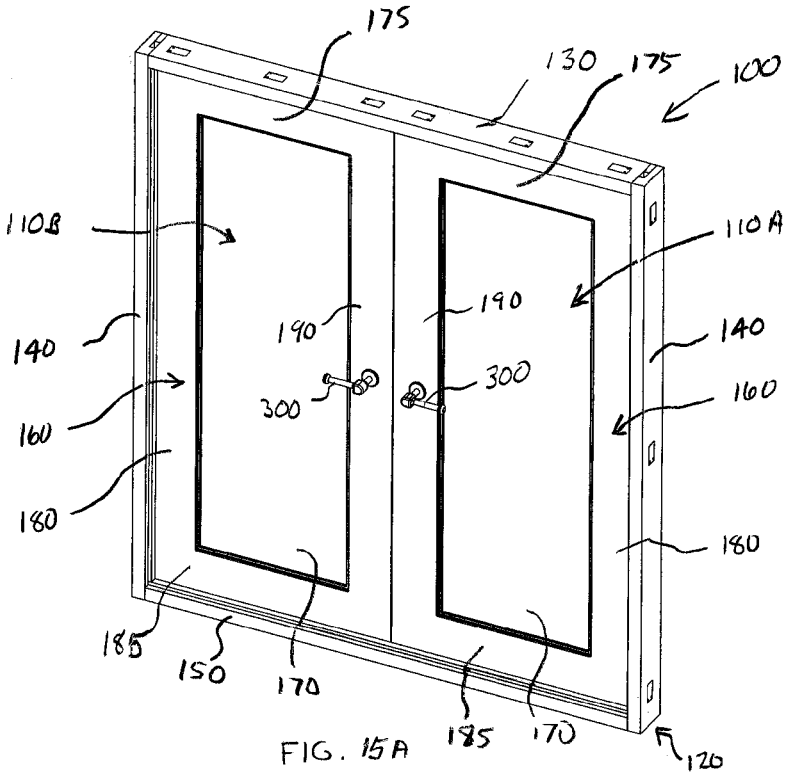
FIGS. 15A and 15B are perspective views of a double door/window system in an open and closed position, respectively, in accordance with the inventive arrangements.
Figure 15B:
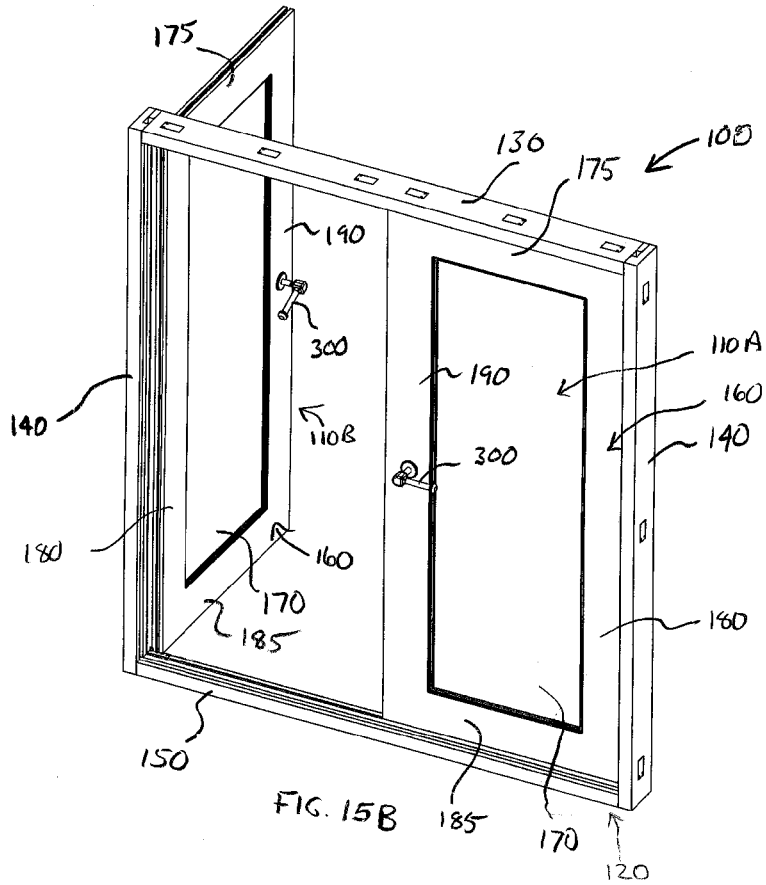
Figure 16:
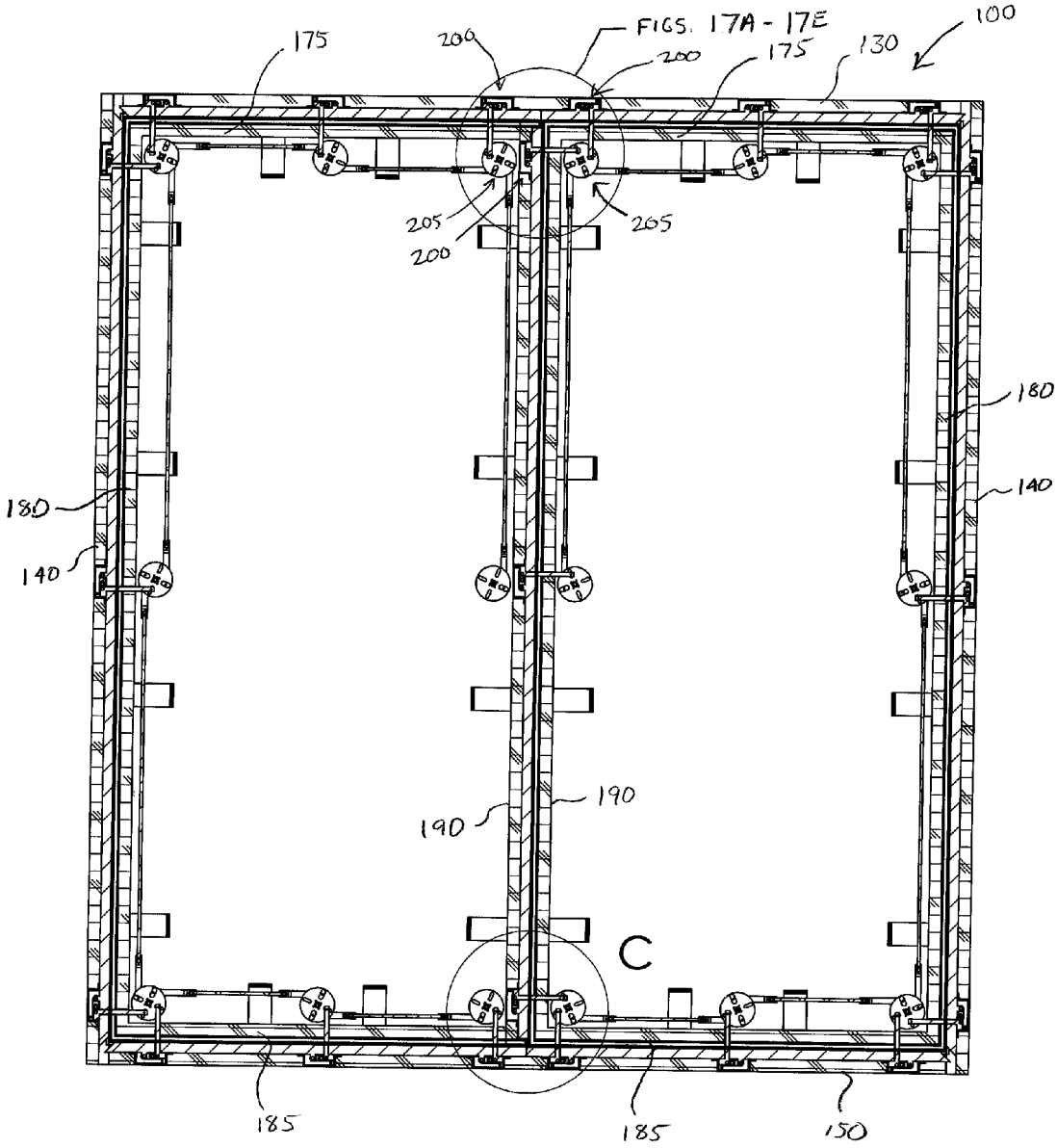
FIG. 16 is a front, partial cross-sectional view of the double door/window system in accordance with the inventive arrangements.

FIGS. 15A and 15B illustrates an exemplar double door/window system 100 for use with the combination sealing system 200 and seal activation system 205. The combination sealing system 200 and seal activation system 205 can be used with many types of doors and/or windows, and the combination sealing system 200 and seal activation system 205 is not limited to the particular double door/window system 100 illustrated. For example, the combination sealing system 200 and seal activation system 205 may be used with pocket doors, sliding doors, French doors, entry doors, garage doors, sliding windows, single-hung windows, double-hung windows, casement windows, and awning windows. The double door/window system 100 includes at least two panels 110A, 110B within a stationary frame 120. Although not limited in this manner, the panels 110A, 110B may pivot relative to the frame 120.

The frame 120 may include a header 130, jambs 140, and a sill 150. A header 130 is a structural member that spans an upper portion of the window/door opening. Jambs 140 are the outermost vertical side members of the frame 120. A sill 150 is a threshold or structural member that spans a lower-most portion of the window/door opening. As recognized by those skilled in the art, different terms may also be associated with the above-structure identified as the header 130, jambs 140, and sill 150.

Each panel 110A, 110B may include a sash 160 that surrounds a pane 170. The pane 170 is not limited as to a particular material. For example, the pane 170 may be translucent, such as glass or plastic, opaque, such as with wood or metal, or any combination thereof. The sash may include a header rail 175, a jamb or stile rail 180, a sill rail 185, and a meeting stile 190. As recognized by those skilled in the art, different terms may also be associated with the structure identified as the header rail 175, the jamb or stile rail 180, the sill rail 185, and the meeting stile 190. The respective jamb/stile rails 180 of the panels 110A, 110B that adjoin one another when the double door/window system 100 is closed are also know as meeting stiles 190.

Referring to FIGS. 16 and 17A-17E, the combination sealing system 200 and seal activation system 205 may be used with each of the members 175, 180, 185, 190 of the sash 160 to form a seal 230 (see FIGS. 17C, 17E) between each pair of adjacent surfaces of the sash 160 of the panel 110 and the frame 120 and between the meeting stiles 190 of the panels 110A, 110B. In this manner, each of the separate sides of the panels 110 may employ the combination sealing system 200 and seal activation system 205. As will be described in more detail below, not only does the combination sealing system 200 and seal activation system 205 provide at least one seal between adjacent members of sash 160 and frame 120 and between the meeting stiles 190, the combination sealing system 200 and seal activation system 205 may be configured to prevent the movement of the panels 110A, 110B relative to the frame 120. In so doing, the combination sealing system 200 and seal activation system 205 can act as a lock and/or security device that prevents the forced opening of the panels 110A, 110B relative to the frame 120. Many types of sealing systems 200 and seal activation systems 205 so capable are known in the art, and the present door/window system 100 is not limited as to a particular type of sealing system 200 or sealing activation system 205.

Although the present double door/window system 100 is described herein with particular types of sealing systems 200 being positioned in particular locations in the frame 120, the door/window system 100 is not limited as to a particular type of sealing system 200 and/or a particular location of the sealing system 200 within the frame 120. Additionally, although the present door/window system 100 is described herein with particular types of seal activation systems 205 being positioned in particular locations in the panels 110A, 110B, the door/window system 100 is not limited as to a particular type of seal activation system 205 and/or a particular location of the seal activation system 205 within the panels 110A, 110B. For example, although sealing systems 200 are shown as being positioned in the meeting stile 190 of the first panel 110A and seal activation systems 205 are shown as being positioned in the meeting stile 190 of the second panel 110B, this positioning can be reversed such that sealing systems 200 are positioned in the meeting stile 190 of the second panel 110B and seal activation systems 205 are positioned in the meeting stile 190 of the first panel 110A.

To prevent the forced opening of the panels 110A, 110B, the sealing systems 200 are not limited as to a percentage of coverage between particular members of the frame 120 and/or panels 110A, 110B or between the meeting stiles 190 of the panels 110A, 110B. For example, the sealing systems 200 may only cover a fractional number (e.g., 10%, 50%, 85%) of the length between particular members of the frame 120 and/or a particular panel 110A, 10B or of the length between the meeting stiles 190. However, in certain aspects, the sealing systems 200 provide substantially complete coverage between the sash 160 of a particular panel 110A, 110B and the frame 120 and substantially complete coverage between the meeting stiles 190 of the panels 110A, 110B. In so doing, the combined sealing systems 200 can provide a seal substantially, completely around and between the panels 110A, 110B.

Referring to FIG. 17A-17E, operation of the seal activation system 205 and sealing system 200 between meeting stiles 190 of the panels 110A, 110B are further described. Although, the seal activation systems 205 of the panel 110A including both sealing systems 200 and seal activation systems 205 are shown as being engaged first, the double door/window system 100 is not limited in this manner. For example, the seal activation systems 205 of the panel 110B having only seal activation systems 205 may be engaged first. Additionally, the seal activation systems 205 of both panels 110A, 110B may be simultaneously engaged.

Figure 17A:
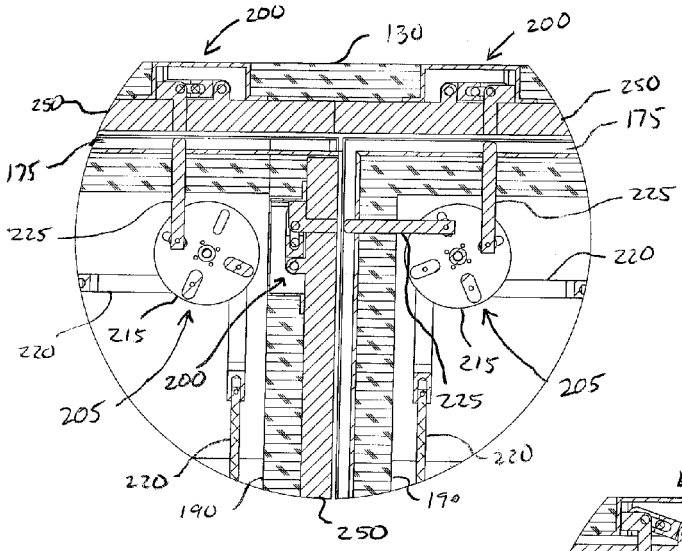
FIGS. 17A-17E are isolated detail views of the combination sealing system and seal activation system in accordance with the inventive arrangements at a corner of the intersection between both panels of the double door/window system, in unlocked, various partially engaged, and locked configurations.
Figure 17B:
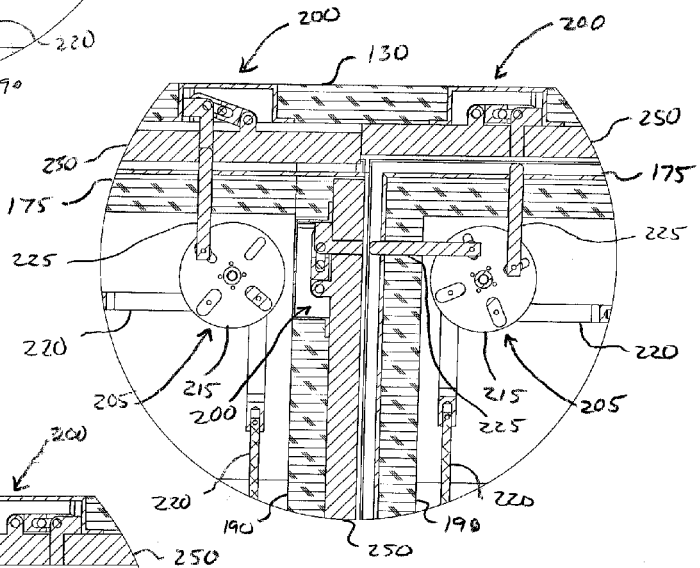
Figure 17C:
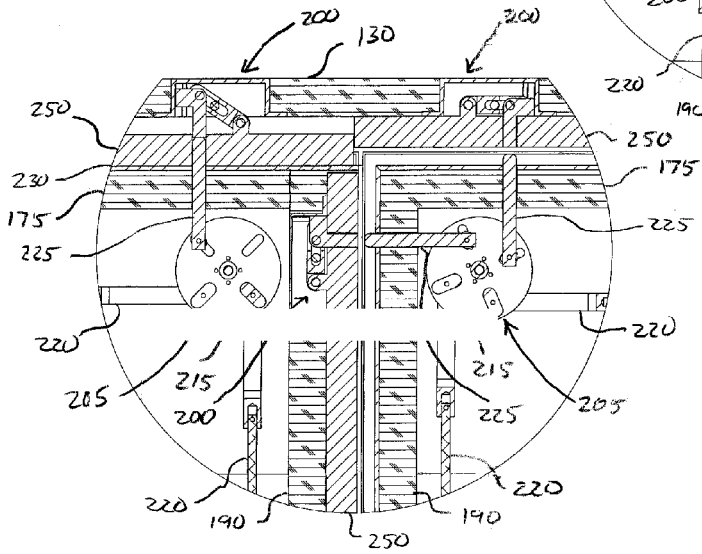

Referring specifically to FIGS. 17A-17C, the sealing system 200 within the frame 120 opposite to the first panel 110A is positioned into the locked configuration after being engaged by the seal activation system 205 positioned within the meeting stile 190 of the first panel 110A. The manner in which the sealing system 200 is positioned into the locked configuration has previously been described, for example, with regard to FIGS. 5A-5C.

Figure 17D:
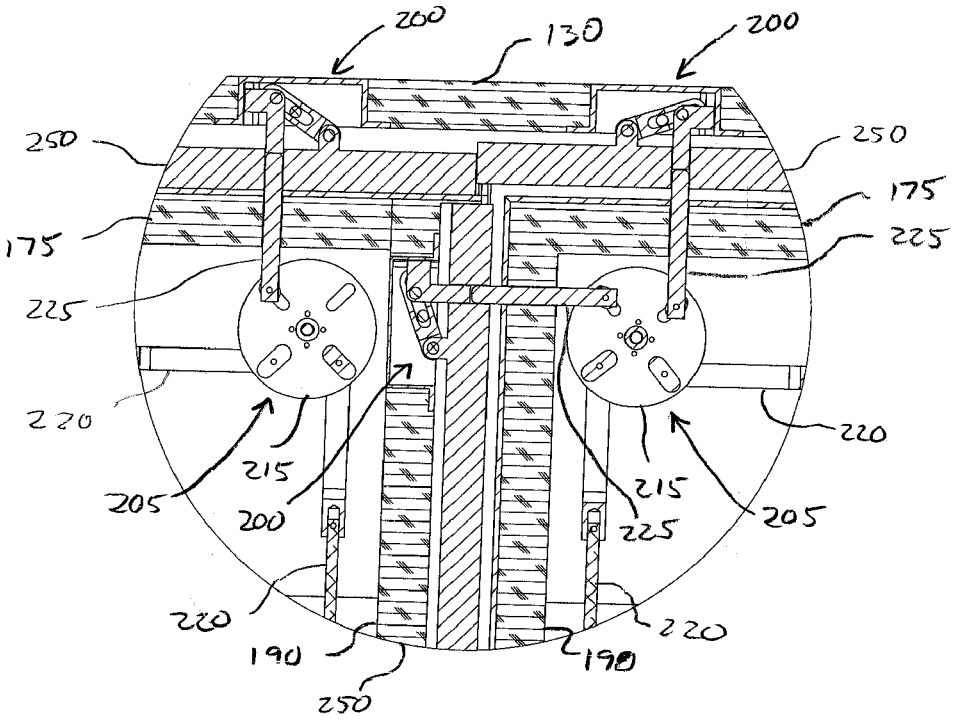
Figure 17E:
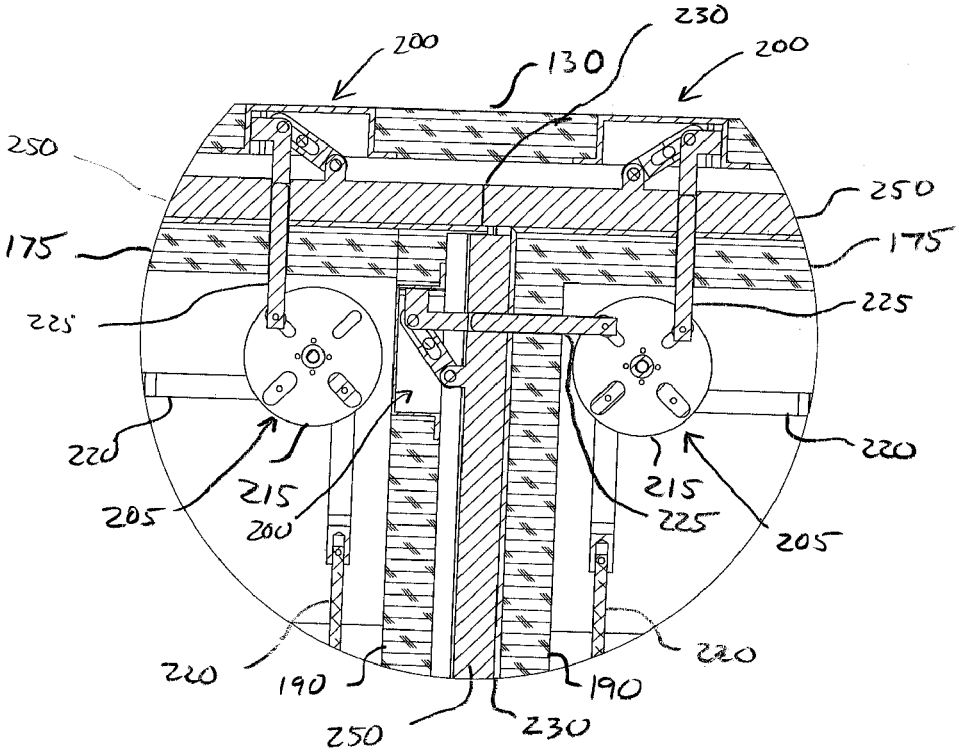

Referring specifically to FIGS. 17C-17D, the sealing system 200 within the meeting stile 190 of the first panel 110A is positioned into the locked configuration after being engaged by the seal activation system 205 positioned within the meeting stile 190 of the second panel 110B. The seal activation system 205 within the meeting stile 190 of the second panel 110B may also engage a sealing system 200 positioned within the frame 120. The manner in which both the sealing system 200 within the meeting stile 190 of the first panel 110A and the sealing system 200 within the frame 120 are positioned into the locked configuration has also been previously described, for example, with regard to FIGS. 5A-5C.

What is claimed is:

1. A combined sealing system and seal activation system for use with a double door system and a frame surrounding the double door system, comprising:

a first panel;

a second panel;

a first sealing system positioned within a meeting stile of the first panel and including a movable member;

a first seal activation system configured to activate the first sealing system and positioned within a meeting stile of the second panel and including a movable member configured to engage the first sealing system; a plurality of additional sealing systems respectively connecting all pairs of adjacent sides of the frame and the first and second panels, wherein each of the additional sealing systems including a sealing activation system configured to activate the additional sealing system, the movable member of the first sealing system being caused to move towards the second panel by the first sealing system being engaged by the movable member of the first seal activation system moving towards the first panel.

2. The combined sealing system and seal activation system of claim 1, wherein the first panel and the second panel separately pivot relative to said frame surrounding the double door system.

3. The combined sealing system and seal activation system of claim 1, wherein in an engaged configuration of the first seal activation system, the movable member of the first sealing system engages a portion of the meeting stile of the second panel to form a seal between the first panel and the second panel.

4. The combined sealing system and seal activation system of claim 1, wherein in an engaged configuration of the first seal activation system, the movable member of the first sealing system extends into a slot within the second panel to prevent movement of the first panel relative to the second panel.

5. The combined sealing system and seal activation system of claim 1, wherein the first sealing system provides a seal substantially, entirely between the meeting stile of the first panel and the meeting stile of the second panel.

6. The combined sealing system and seal activation system of claim 1, wherein the first sealing system is a reciprocal motion sealing system.

7. A combined sealing system and seal activation system for use with a double door system, comprising:

a first panel;

a second panel;

a first sealing system positioned within a meeting stile of the first panel;

a first seal activation system configured to activate the first sealing system and positioned within a meeting stile of the second panel and including a movable member configured to engage the first sealing system, a second sealing system positioned within a frame surrounding the door system; and a second seal activation system for activating the second sealing system and positioned with the second panel on one side of the second panel, wherein the first sealing activation system positioned within the second panel on another side of the second panel different than the one side of the second panel, the first sealing system including a movable member, and the movable member of the first sealing system being caused to move towards the second panel by the first sealing system being engaged by the movable member of the first seal activation system moving towards the first panel.

8. The combined sealing system and seal activation system of claim 7, wherein the first and second seal activation systems are interconnected via at least one connecting member, and positioning the first seal activation system to an engaged configuration causes positioning of all seal activation systems to an engaged configuration.

* * * * *